US006708961B2

(12) United States Patent
Ferber et al.

(10) Patent No.: US 6,708,961 B2
(45) Date of Patent: Mar. 23, 2004

(54) AIR BUBBLE MASSAGE BATHTUB MAT SYSTEM

(75) Inventors: Roman S. Ferber, West Bloomfield, MI (US); Stephen Chung, Taipei (TW)

(73) Assignee: HoMedics, Inc., Commerce Township, MI (US)

( * ) Notice: Subject to any disclaimer, the term of this patent is extended or adjusted under 35 U.S.C. 154(b) by 35 days.

(21) Appl. No.: 10/167,931

(22) Filed: Jun. 12, 2002

(65) Prior Publication Data

US 2002/0188237 A1 Dec. 12, 2002

Related U.S. Application Data

(63) Continuation-in-part of application No. 09/833,401, filed on Apr. 11, 2001.

(51) Int. Cl.[7] ..... B01F 3/04

(52) U.S. Cl. ..... 261/122.1; 261/124; 4/541.5

(58) Field of Search ..... 261/77, 121.1, 261/124, 122; 601/157, 168; 4/541.5, 583

(56) References Cited

U.S. PATENT DOCUMENTS

| | | | | |
|---|---|---|---|---|
| 921,734 | A | * | 5/1909 | Pugh |
| 1,702,635 | A | * | 2/1929 | Hasalone |
| 2,732,565 | A | * | 1/1956 | Weber |
| 3,076,976 | A | * | 2/1963 | Bogar |
| 3,420,227 | A | | 1/1969 | Voorlas |
| 3,809,073 | A | | 5/1974 | Baumann |
| 3,835,483 | A | * | 9/1974 | Emery et al. |
| 4,048,266 | A | | 9/1977 | Baumann |
| 4,139,001 | A | | 2/1979 | Macabee |
| 4,290,982 | A | | 9/1981 | Bauman |
| 4,625,715 | A | | 12/1986 | Bucher |
| 4,962,759 | A | | 10/1990 | Stern et al. |
| 5,054,473 | A | | 10/1991 | Sandrin |
| 5,080,091 | A | | 1/1992 | Peterson et al. |
| 5,090,403 | A | | 2/1992 | Bucher |
| 5,117,233 | A | | 5/1992 | Hamos et al. |
| 5,144,703 | A | * | 9/1992 | Maire |
| 5,481,764 | A | * | 1/1996 | Nelson |
| 5,682,626 | A | * | 11/1997 | Banks, Jr. et al. |
| 6,114,002 | A | | 9/2000 | Rinaldo |
| D447,243 | S | | 8/2001 | Leung Kit Lun |
| 6,277,086 | B1 | * | 8/2001 | Wu |
| 6,357,061 | B1 | | 3/2002 | Gonzalez |
| 2003/0024042 | A1 | * | 2/2003 | Leung et al. |
| 2003/0045819 | A1 | * | 3/2003 | Leung et al. |

FOREIGN PATENT DOCUMENTS

| | | | |
|---|---|---|---|
| DE | 3435453 A1 | | 10/1986 |
| JP | 2001-113620 | * | 4/2001 |

OTHER PUBLICATIONS

Front and Back photographs of Rigid Gray Plastic Sectional Bath Mat (Prior Art).

Front and Back photographs of Blue Flexible Vinyl Bath Mat (Prior Art).

* cited by examiner

*Primary Examiner*—Scott Bushey
(74) *Attorney, Agent, or Firm*—Brooks Kushman P.C.

(57) ABSTRACT

An air bubble massage bathtub mat system featuring a remote control and a flexible mat is disclosed. The remote control unit communicates with a blower/air heater unit contained in a housing. The housing is connected to the mat by a tube that directs air into the mat. The mat is formed of a flexible polymeric sheet material that may be rolled up for storage. The mat includes a plurality of flexible blocks that are retained between two layers of polymer sheet material that also define the air passages in the mat. Air flows through the mat and exits the mat in small holes that provide small air bubbles to water contained in a bathtub. Suction cups attached to elongated strips which are held to the mat by elongated pockets hold the mat stationary in the bathtub.

10 Claims, 7 Drawing Sheets

AIR BUBBLE MASSAGE BATHTUB MAT SYSTEM

This application is a continuation-in-part of Ser. No. 09/833,401 filed Apr. 11, 2001.

BACKGROUND OF THE INVENTION

1. Field of the Invention

The present invention relates to an air bubble massage bathtub mat system.

2. Background Art

Bath massage systems have been developed that include a mat placed in a bathtub through which compressed air is directed. Compressed air is provided by an air pump. The compressed air is emitted from the mat in the form of bubbles for massaging a bather.

One example of a prior art mat for bubbling compressed air through bath water is disclosed in U.S. Pat. No. 3,809,073 that is provided with an electronic control on the housing of the pump unit. The housing includes an insulating cover that prevents a bather from touching the electronic controls without first opening the cover to switch off the electric current.

Another example of a bubbling air mat is disclosed in U.S. Pat. No. 4,962,759 that discloses a rope heating element for warming the air stream that is directed through an air hose to the bubbling air mat.

U.S. Pat. No. 5,090,403 discloses an air bubble mat that is formed from two foils placed on top of one another between which air feed ducts or air chambers are defined.

There is a need for an air bubble massage bathtub mat system that offers a convenient way to control operation of the system. In particular there is a need for remote control to minimize any potential shock hazard and eliminate the need for a bather to exit the bathtub to operate an alternating current powered pump control. It would also be desirable to eliminate any need to attempt to manually contact the pump control while remaining in the bathtub. The remote control should be capable of controlling the heat of the air injected, time of operation, and level of air output. It would also be desirable to provide for the selection of a programmable massage cycle that may be controlled by the remote control.

There is also a need for an air bubble massage bathtub mat that is simply constructed and durable for long product life. It would also be desirable to provide a air bubble massage bathtub mat that is designed to assure adequate air distribution for substantially uniform bubbling action. Another desirable feature would be to provide a bathtub mat that remains in position in the bathtub and may be attached and detached without modification of the bathtub surface. It would also be desirable to provide a bath mat that can be attached and detached from bathtubs with no-slip surfaces. Additionally, it would be desirable to provide an air bubble massage mat that has the ability to stick to bathtubs with no-slip surfaces on the bottom of the tub. It would also be desirable to provide an air bubble massage bathtub mat made of thermoplastic sheet material that is flexible and may be rolled up for compact storage. A bathtub system is needed that also provides for convenient storage of all components parts.

This invention addresses the above noted problems and fulfills the above needs as summarized below.

SUMMARY OF THE INVENTION

According to one aspect of the present invention an air bubble massage bathtub mat system is provided that may have a remote control. The system includes an air pump that provides a source of compressed air to a mat having at least one air passage and a plurality of air outlet holes. A hose connects the air pump to the air passage in the mat and a controller is provided for controlling operation of the air pump. A remote control unit is provided that communicates by an infrared digital signal with the controller.

The system has a housing for an air pump and heater that also includes a control panel having a plurality of switches for controlling the air pump and heater. The heater uses a heating element downstream of the air pump but within the housing to heat the compressed air. The remote control unit has switches for controlling generally the same functions as the control panel. The controller and remote control unit both, if desired, may have switches for controlling predetermined massage program cycles. The massage program cycles may be varied to provide massage cycles of different durations. The massage programs may vary the air pump speed according to a predetermined cycle with gradual or immediate changes in strength of bubbling action. The massage cycle may also vary the speed of the massage cycle changes.

According to another aspect of the invention, the system provides for convenient storage of component parts. The mat is formed of a flexible material, such as a soft vinyl, that may be rolled up for storage. A recess may also be formed on the housing of the air pump for storing the remote control unit. A bracket may also be provided for the remote control unit that is adapted to be secured to a supporting surface spaced from the housing but preferably within the easy reach of a bather using the air bubble massage bathtub mat system.

According to another aspect of the invention, an air bubble massage bathtub mat is provided for an air bubble massage system that provides compressed air to the mat when the mat is disposed in the bathtub. The mat includes a flexible member having at least two layers defining a plurality of air passages. The mat includes a receptacle through which compressed air is provided to the air passages. A plurality of air holes are formed in the air passages through which compressed air is emitted from the air passages into the bathtub. A plurality of flexible blocks are secured to or within the flexible member at spaced locations adjacent the air passages.

The flexible member of the air bubble massage system may be formed of at least two layers of polymer sheet material that are secured together at spaced locations to define the air passages. The flexible blocks may be retained between two layers of polymer sheet material in separate areas from the air passages. The polymer sheet material may be polyethylene, a soft vinyl such as polyvinyl chloride, or another flexible thermoplastic sheet material.

A plurality of suction cups are secured to the bottom of the flexible member to provide a detachable connection to the bathtub. The suction cups may be secured in groups to a segment of the same type of polymer used to make the bath mat. Alternatively, a composite material may be used for the suction cups, wherein a polymeric material forms an upper part of each cup secured to the flexible member and a rubber material forms a lower part of each cup for contacting the bathtub and providing the detachable connection.

According to another aspect of the invention, an elongated member formed of a resilient material may be attached to the mat. The elongated member contains at least one end portion that extends outwardly from the mat. The suction cups are attached to the end portions of the elongated member. The elongated member may be shiftably attached to the mat by a sleeve. The sleeve may be made of the same type of flexible polymeric sheet material as the mat. The resilient material of the elongated member applies a downward biasing force on the mat.

The suction cups may be designed to be detachably secured to the bathtub. When the suction cups are attached to a bathtub, a vacuum is formed which causes the end portions to apply a biasing force to hold the bath mat stationary. Alternatively, the vacuum may cause the elongated member to bend, which causes the end portions to apply a compressive force on one side of the elongated member and a tensile force on the other side of the elongated member to hold the bath mat stationary.

According to another aspect of the invention the air holes in the air passages are limited in size and in number to provide a flow restriction that causes the air passages to be inflated when compressed air is provided to the air passages.

According to yet another aspect of the invention each of the flexible blocks are enclosed in a sealed chamber formed of the polymer sheet material having seams that define the air passages and the sealed chambers. The air passages and sealed chambers are separate from each other. The two layers of thermoplastic sheet material may be bonded together about the periphery of the flexible blocks to hold the blocks in place. The layers of thermoplastic sheet material also define air passages that form of a branched array.

Additional features and aspects of the invention will be better understood in view of the attached drawings and detailed description of the invention that follows.

DETAILED DESCRIPTION OF THE PREFERRED EMBODIMENT

Figure 1:
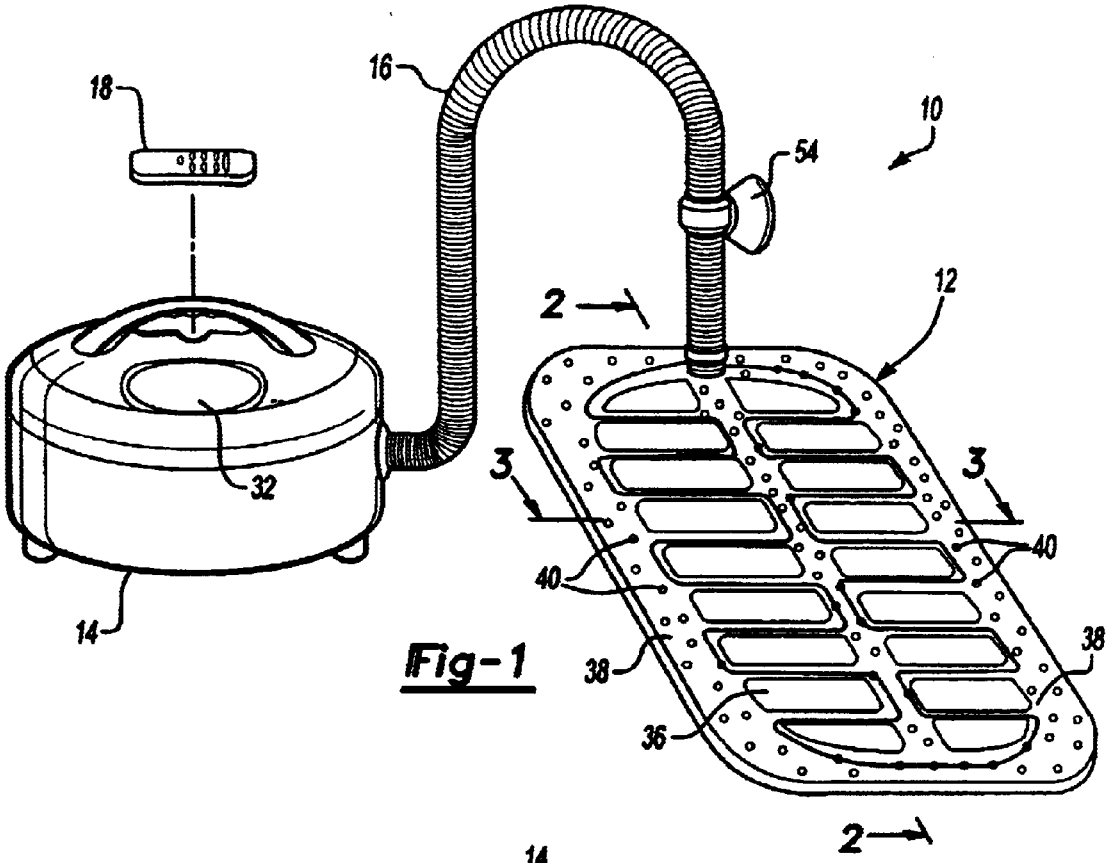
FIG. 1 is a perspective view of an air bubble massage bathtub mat system.

Referring now to FIG. 1, an air bubble massage bathtub mat system 10 is shown. The system 10 includes a mat 12 and blower/air heater unit 14. The mat 12 is connected to the blower/air heater unit 14 by a hose 16 that directs compressed air from the blower/air heater unit 14 into the mat 12. A remote control unit 18 is provided to permit a bather to remotely control the blower/air heater unit 14.

Figure 6:
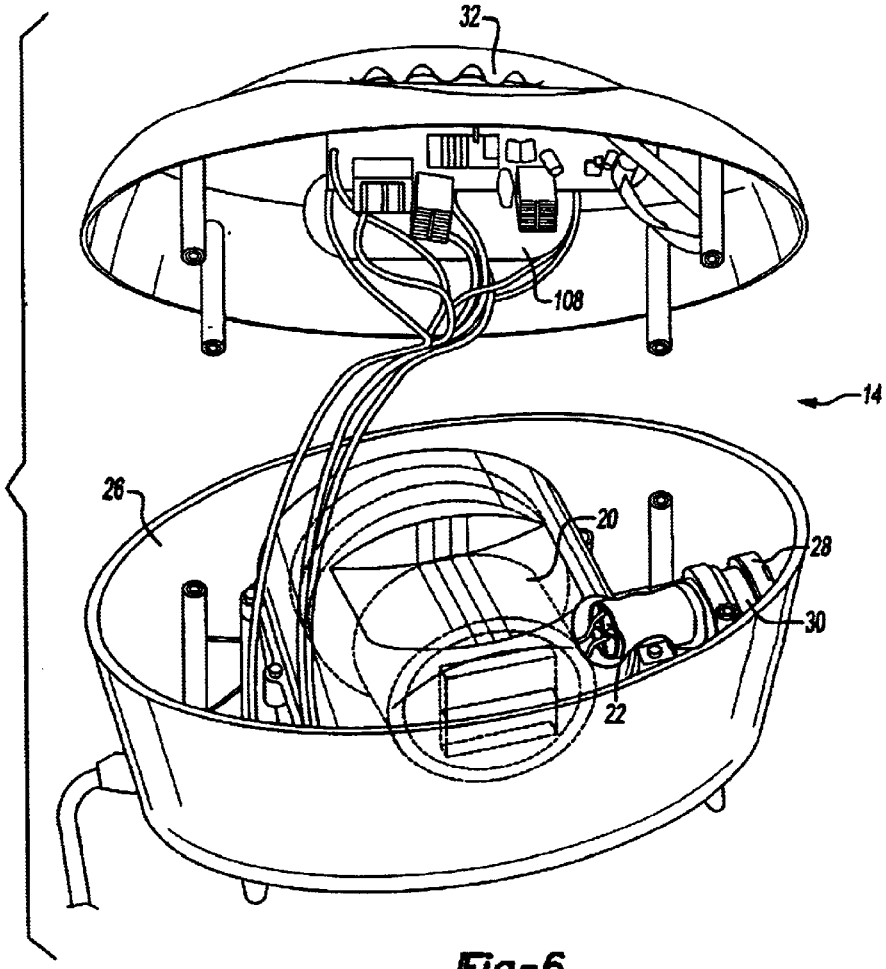
FIG. 6 is a perspective view of the blower/air heater unit partially disassembled.

As shown in FIG. 6, an air pump 20 and heating element 22 are disposed in the housing 26 of the blower/air heater unit 14. The housing 26 includes a receptacle 28 for the hose 16. A check valve 30 is preferably incorporated as part of the receptacle 28 to prevent water from flowing through the hose 16 into the power unit 14. A control panel 32 is provided on the housing 26 for controlling various functions of the blower/air heater unit 14 without using the remote control unit 18.

Figure 2:
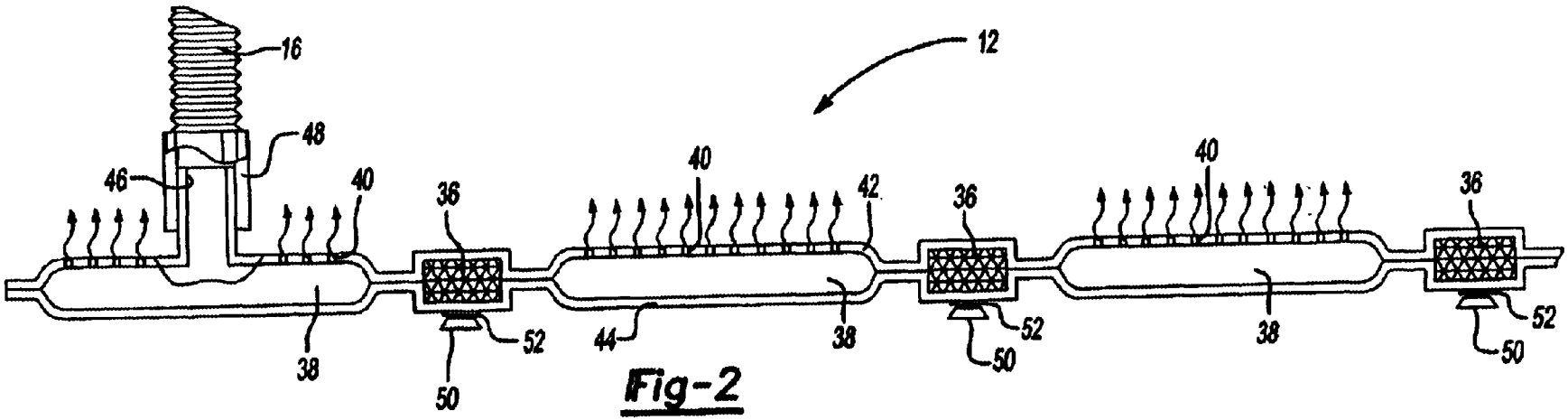
FIG. 2 is a cross sectional view of the air bubble massage bathtub mat taken along the line 2—2 in FIG. 1.
Figure 3:
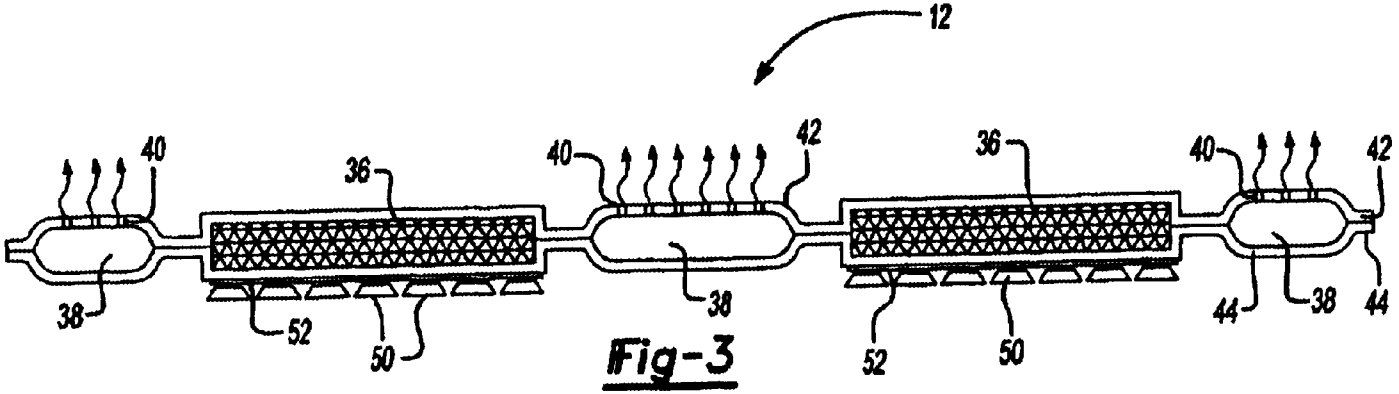
FIG. 3 is a cross sectional view of the air bubble massage bathtub mat taken along the line 3—3 in FIG. 1.

Referring now to FIGS. 1, 2 and 3 the mat 12 will be described in greater detail. The mat 12 includes a plurality of flexible blocks 36 that are secured to or retained within the mat 12. Air passages 38 are defined by the mat 12. Air passages 38 conduct air from the hose 16 to a plurality of holes 40 through which air is permitted to escape into a bath to provide the massaging action of the air bubble massage bathtub mat system 10. The mat 12 is preferably formed by top and bottom sheets of soft vinyl material, such as polyvinyl chloride, or another thermoplastic polymeric material 42, 44 that are bonded together about their periphery and are also bonded at intermediate locations to locate or affix the flexible blocks 36 and also to form the air passages 38. The sheets of polymeric material 42, 44 are preferably bonded together by heat or ultrasonic welding but could also be chemically bonded.

The mat 12 includes a receptacle 46 for receiving a hose end 48 at one end of the mat 12. The mat 12 is secured to a bathtub by means of suction cups 50 that are affixed to the bottom of the mat 12. A plurality of suction cups 50 are secured to strips 52 that are formed of the same thermoplastic polymer used to make the mat 12. The strips 52 permit the suction cups 50 to be secured in groups to the bottom surface of the mat 12. Alternatively, suction cups 50 could be formed from a composite material including a polymeric material adapted to be secured to strips 52 and a rubber material adapted to contact the bathtub and provide the detachable connection thereto. A hose holder 54 is provided to temporarily secure the hose 16 to the bathtub preferably by means of a suction cup.

Figure 4:
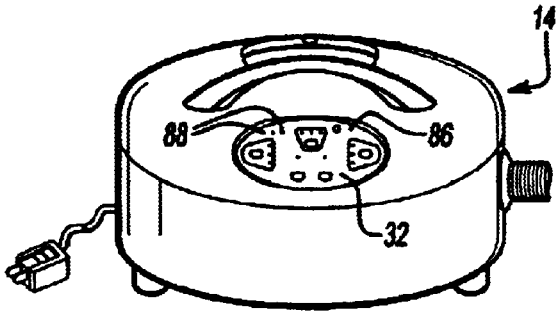
FIG. 4 is a perspective view of the blower/air heater unit for the air bubble massage bathtub mat system.

Referring now to FIG. 4, the control panel 32 of the blower/air heater unit 14 is shown to include a power switch 56 for turning the power unit on and off. A heat switch 58 is provided for turning on and off or setting the level of heat to be imparted to the compressed air flow by the heating element 22 contained in the blower/air heater unit 14. A timer switch 60 is provided to permit a user to set the duration of operation of the power unit. A speed switch 62 is provided to control the speed at which programmed massage cycles progress. A strength switch 64 controls the speed of operation of the air pump 20 that controls the strength of the bubbling action. A massage switch 66 is provided to control the massage level. A program switch 68 permits a user to program the blower/air heater unit 14 to operate on a predetermined cycle that provides programmed changes of massage cycles to be automatically generated.

Figure 5:
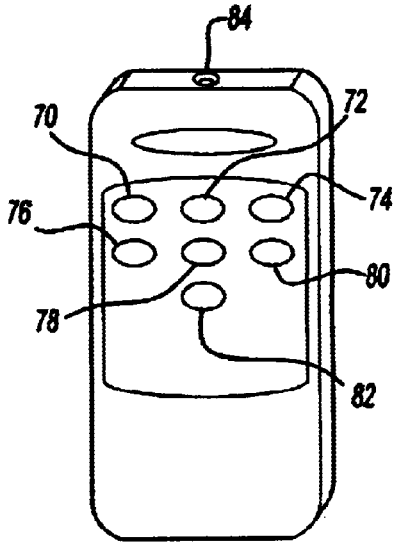
FIG. 5 is a perspective view of a remote control unit for use with the blower/air heater unit.

Referring now to FIG. 5, the remote control unit 18 is shown in greater detail. The function buttons on the remote control unit 18 generally correspond to the switches on the control panel 32 of the blower/air heater unit 14. The remote control unit 18 includes a remote power switch 70, a remote heat switch 72, a remote timer switch 74, a remote speed switch 76, a remote strength switch 78, a remote massage switch 80 and a remote program switch 82. The remote control unit 18 also includes an infrared light transmitter 84. The remote control unit 18 should be pointed towards the blower/air heater unit 14 so that infrared light emitted by the infrared light transmitter 82 is received by an infrared light receiver 86 on the blower/air heater unit 14. Alternatively, a radio frequency link could be used instead of the infrared link.

The control panel 32 includes a plurality of diodes 88 or other indicator lights, that indicate the status of the blower/air heater unit 14. When the switches on the control panel 32 or the remote switches on the remote control unit 18 are actuated the diodes 88 are illuminated to indicate the status of the blower/air heater unit 14.

Figure 7:
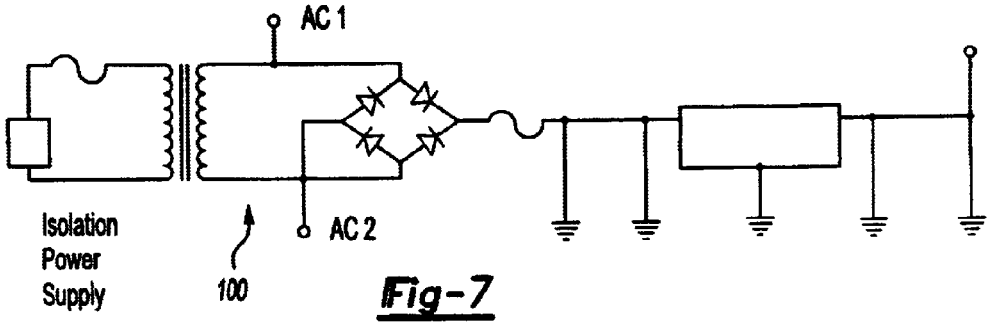
FIG. 7 is an electrical schematic for the isolation power supply for a control panel of the blower/air heater unit.

Referring now to FIG. 7, an isolation power supply 100 is shown through which power is provided to the blower/air heater unit 14 control panel 32. The isolation power supply 100 is of the Class II type and it is used to isolate the user from primary voltage at the control panel. Other power supplies could also be used.

Figure 8:
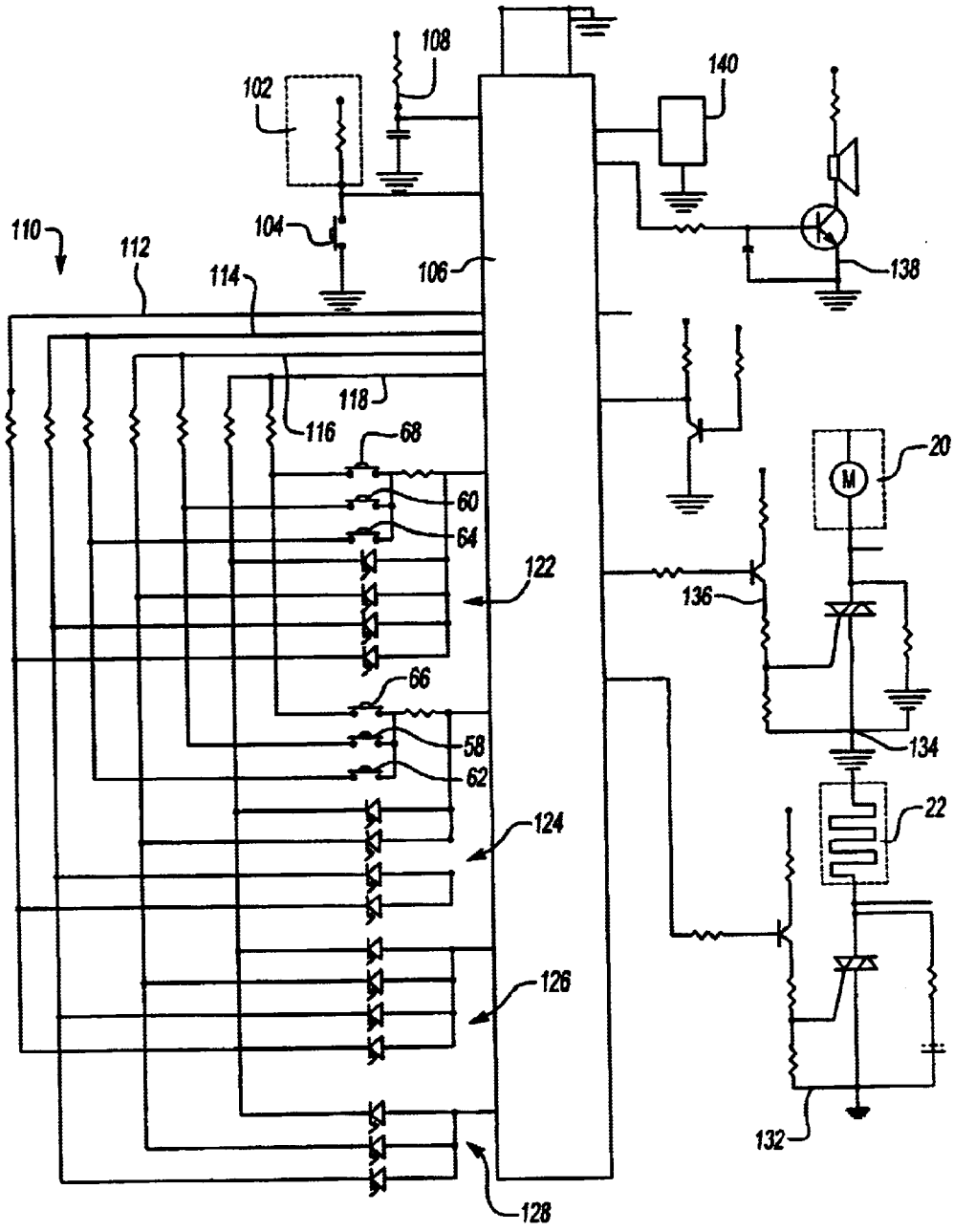
FIG. 8 is an electrical schematic diagram of the blower/air heater controller.

Referring now to FIG. 8, a schematic electrical diagram for the blower/air heater unit 14 is shown. A power supply 102 is controlled by power switch 104. A microprocessor 106 that may be a programmable integrated circuit is programmed to control the operation of the blower/air heater unit 14 in accordance with user controlled and preprogrammed inputs. A clock circuit 108 provides timing for the microprocessor 106.

A control switch and LED grid is generally referred to by reference numeral 110. The microprocessor has a speed input 112, a strength input (blower speed) 114, a duration input 116 and a massage program/manual input 118. Each of the inputs 112–118 are provided to the microprocessor 106 on separate pins of the microprocessor. The heat switch 58, timer switch 60, speed switch 62, strength switch 64, massage switch 66 and program switch 68 are incorporated in the control switch and LED grid 110 and are connected to the input lines 112–118. In the embodiment illustrated in FIG. 8, three different programs are provided with each program having indicator lights provided by first, second and third programmed LED sets 122, 124 and 126. For example, first program set may include a timing setting of 60 minutes, a high strength setting and a high speed setting. Second program may include a time of 30 minutes, a strength of medium and a speed of medium. The third program set may, for example, have a duration of 15 minutes with a low strength setting and a low speed setting. If it is desired to operate the system on a manual basis the manual operation may be indicated by a general LED set 128. If desired, a different number of programs having different operational characteristics can be provided.

The microprocessor is used to control the outputs of the system including a heater control 132 that controls the heating element 22. Heating element 22 is connected to an alternating current tap at 134. A motor speed control 136 is also controlled by the microprocessor to control operation of the air pump 20. The air pump 20 is also connected to the alternating current tap at 134. The microprocessor 106 may also control a timer/buzzer control 138 that may be set to alert a bather to a time limit.

The microprocessor is also provided with a digital input from a receiver microprocessor 140. The receiver microprocessor receives a digital bit stream that is transmitted via infrared light from the remote control unit 18. The function and operation of the remote control unit 18 is described below with reference to FIG. 10.

Figure 9:
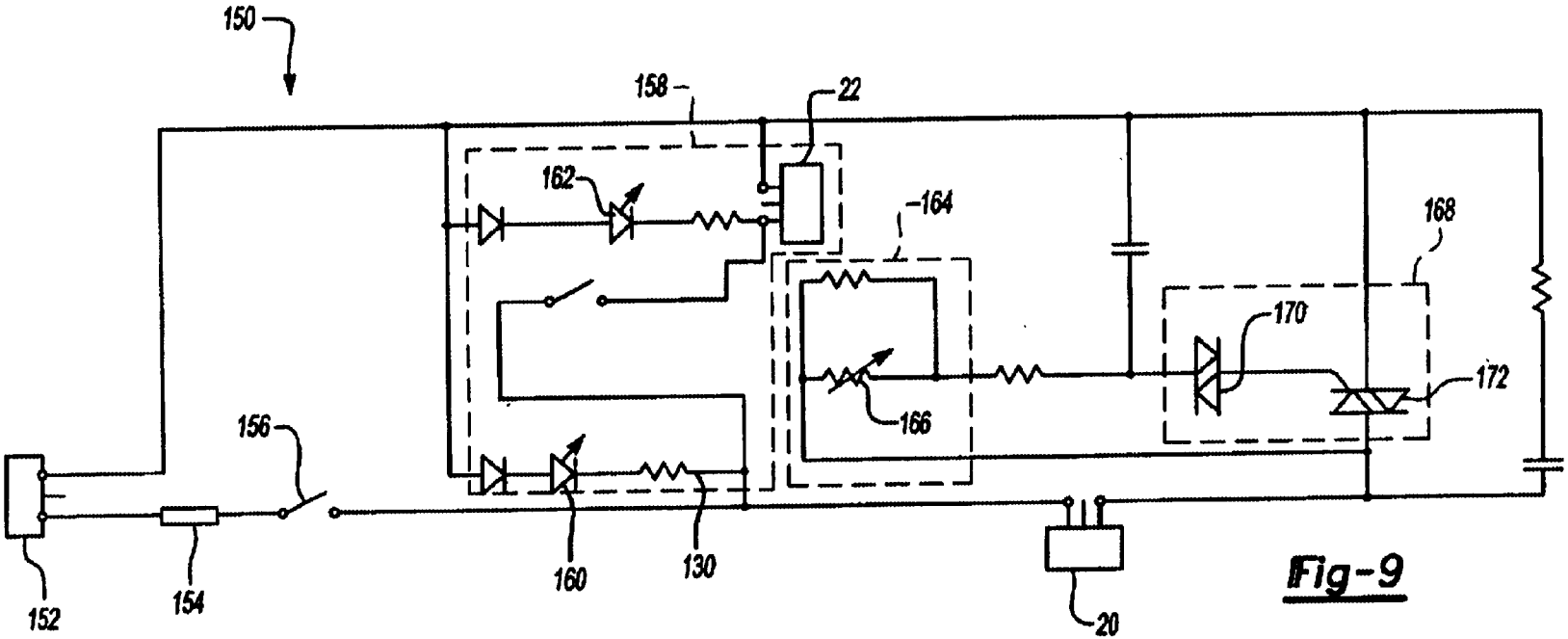
FIG. 9 is an electrical schematic diagram showing an alternative embodiment of a blower/air heater unit.

Referring now to FIG. 9, an alternative embodiment of a power circuit for the blower/air heater unit 14 is shown that has a simplified control and fewer programmable functions. The circuit 150 includes an alternating current power supply 152 that is connected through a fuse 154 to the main power switch 156 of the circuit. A heater on/off control 158 is indicated by an on/off LED 160. The status of the heating element 22 is indicated by a heater LED 162. The air pump or blower speed control is generally indicated by reference numeral 164. A potentiometer 166 controls a gating circuit generally indicated by reference numeral 168 that includes a diac 170 and triac 172 that cooperate to control the speed of operation of the air pump 164. Potentiometer 166 provides blower speed control by adjusting the gating current through diac 170. The output of diac 170 gates triac 172 to vary the speed of operation of the air pump 20.

Figure 10:
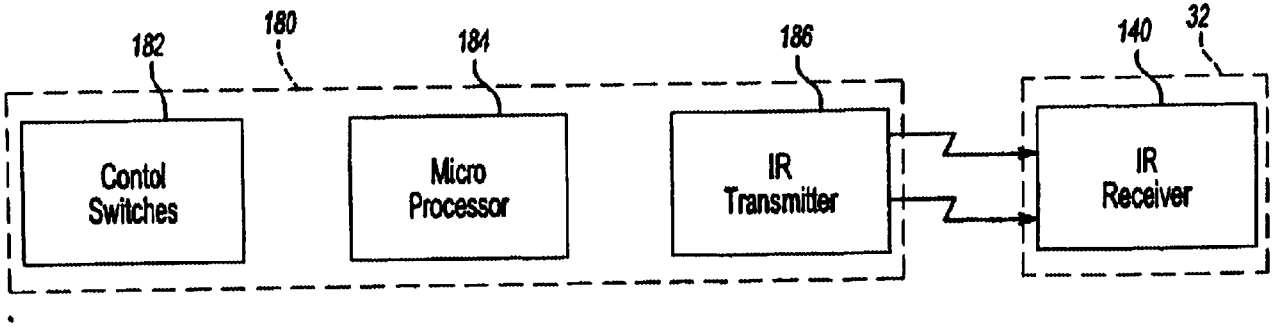
FIG. 10 is a block diagram of the component parts of the remote control unit.

Referring now to FIG. 10, a remote control transmitter circuit is generally indicated by reference numeral 180. Remote control transmitter circuit 180 includes control switches 182 that correspond to switches 70–82 as previously described. The control switches 182 control microprocessor 184 that generates a digital bit stream that is transmitted by an infrared transmitter 186 from the remote control unit 18 by infrared light transmission to an infrared receiver 140 that is located on the control panel 32 of the blower/air heater unit 14.

Figure 11:
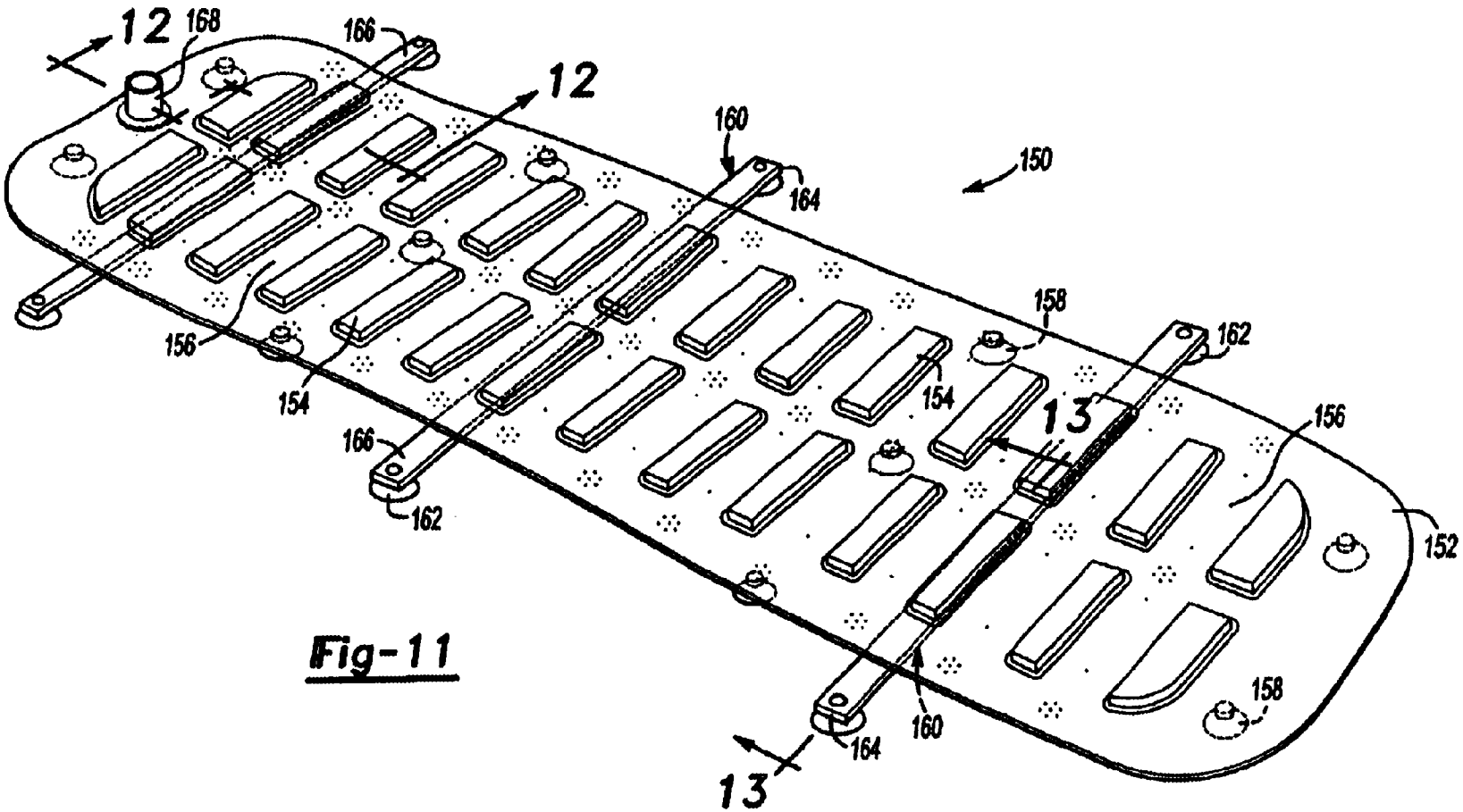
FIG. 11 is a perspective view of an alternative embodiment of the bath mat.

Referring now to FIG. 11, an alternative embodiment of a bath mat 150 is shown to include a body 152 in which a plurality of foam blocks 154 are retained. A plurality of air channels 156 are defined within the body 152 and are separate from the portions of the body encapsulating the foam blocks 154. A first group of suction cups 158 are attached to a lower surface of the body 152.

Elongated strips 160 are secured to the body 152 of the bath mat 150 and may be shiftable in a transverse direction relative to the length of the bath mat 150. The elongated strips 160 may be secured to the body 152 in several different ways. The elongated strips 160 could be fixedly secured to the body 152 or could be connected to the body by means of cooperating elements such as a track and track follower.

A second group of suction cups 162 are provided on the distal ends 164 of the elongated strips 160. The elongated strips include extension portions 166 that extend outboard from both sides of the body 152. The extension portions 166 permit the suction cups 162 to be secured to a bathtub either at a location outboard of anti-slip tape or another anti-slip surface. The suction cups 162 may be secured to the bottom of the bathtub, in the transition curve between the bottom of the bathtub and the side walls, or may be secured to the side walls of the bathtub.

A receptacle 168 is provided at one end of the body 152 to which an air hose (not shown) may be connected to provide compressed air to the air channel 156.

Figure 12:
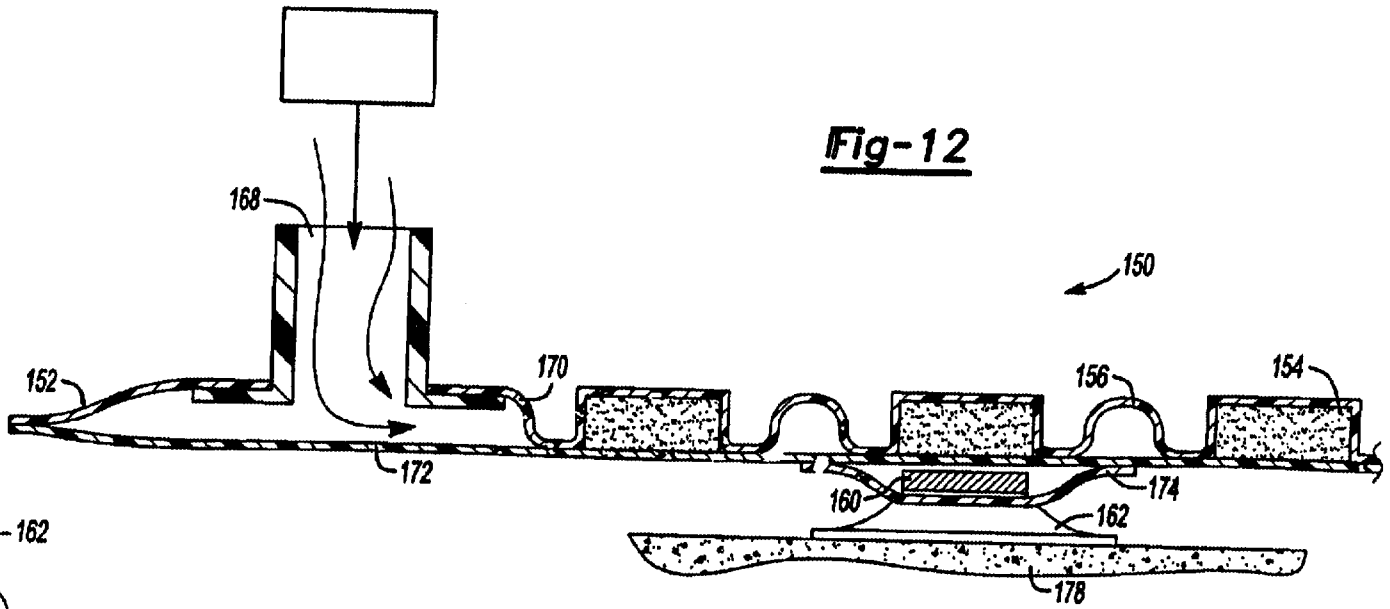
FIG. 12 is a cross-sectional view taken along the line 12—12 in FIG. 11.
Figure 13:
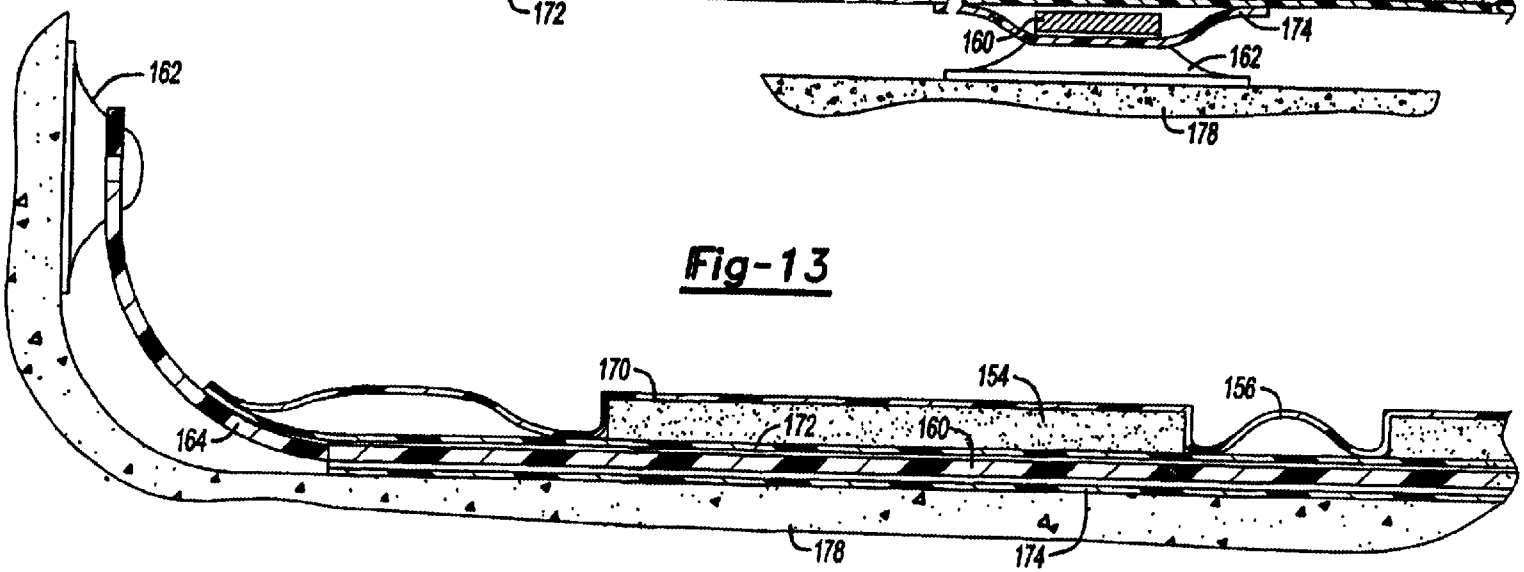
FIG. 13 is a cross-sectional view taken along the line 13—13 in FIG. 11.

Referring now to FIGS. 12 and 13, the structure of the bath mat 150 will be described in greater detail. The body 152 may have an upper layer 170 and a lower layer 172. The upper layer 170 and the lower layer 172 may be held together using a heat sealing process or glue. The foam blocks 154 are sealed in between the upper layer 170 and the lower layer 172. An elongated pocket 174 is secured on the lower layer 172 on two edges with the opposite sides of the pocket being open. The elongated pocket 174 is preferably secured to the lower layer by heat sealing or by glue. The elongated strips 160 are attached to the body 152 by the elongated pockets 174. The ends of the elongated strips 164 protrude outwardly from the elongated pockets 174 through the open sides of the pocket 174. This allows the second group of suction cups 162 to be attached to the bathtub 178 outboard of the body 152. Depending on the length of the ends 164, the second group of suction cups 162 can be attached to the bottom, the side walls, or the transition between the bottom and the side walls of the bathtub 178. When the second group of suction cups 162 is attached to the bathtub 178, the ends 164 exert a biasing force on the elongated strips 160. This force holds the body 152 against the bottom of the bathtub 178. Alternatively, applying the second group of suction cups 162 to the side wall of the bathtub 178 can cause the elongated strips 160 to bend applying a compressive force on one side of the elongated strips 160 and a tensile force on the other side of the elongated strips 160. These forces urge the body 152 toward the bottom of the bathtub 178.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An air bubble massage bathtub mat system comprising:

an air pump that provides a source of compressed air;

a mat having a top side and a bottom side and at least one air passage and a plurality of air outlet holes;

a hose connecting the air pump to the air passage in the mat;

a controller for controlling operation of the air pump;

an elongated member attached to the mat and having at least one end portion that extends outwardly from the mat; and at least one suction cup attached to each of the end portions.

2. The air bubble massage system of claim 1 wherein the elongated member is formed of a resilient material that exerts a downward biasing force on the mat.

3. The air bubble massage system of claim 1 wherein a sleeve is provided on the mat and the elongated member extends through the mat to be thereby attached to the mat.

4. The air bubble massage system of claim 1 wherein the elongated member extends outwardly from the mat on two sides.

5. The air bubble massage system of claim 1 wherein the elongated member has two end portions extending outwardly from the mat on two opposite sides and wherein each end portion has one suction cup on each end portion, the suction cup on each end may be secured to a bottom of the bathtub, may be secured in a transition curve between the bottom of the bathtub and a side wall, or may be secured to the side walls of the bathtub.

6. The air bubble massage system of claim 5 wherein the elongated member is shiftably attached adjacent to the top side of the mat.

7. The air bubble massage system of claim 5 wherein the elongated member is shiftably attached adjacent to the bottom side of the mat.

8. The air bubble massage system of claim 5 wherein the elongated member is attached to the mat to extend transversely relative to the mat and is transversely shiftable.

9. The air bubble massage system of claim 5 wherein the sleeve and mat are formed of the same type of a flexible polymeric sheet material.

10. The air bubble massage system of claim 1 wherein the at least one suction cup is attached to the bottom side of the mat.

* * * * *